US011226580B2

(12) United States Patent
Fukaya et al.

(10) Patent No.: US 11,226,580 B2
(45) Date of Patent: Jan. 18, 2022

(54) DRUM CARTRIDGE AND IMAGE FORMING APPARATUS

(71) Applicant: BROTHER KOGYO KABUSHIKI KAISHA, Nagoya (JP)

(72) Inventors: Atsushi Fukaya, Toyohashi (JP); Hiroki Mori, Nagoya (JP); Nao Itabashi, Nagoya (JP); Tsubasa Kiriyama, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/171,135

(22) Filed: Feb. 9, 2021

(65) Prior Publication Data

US 2021/0255573 A1 Aug. 19, 2021

(30) Foreign Application Priority Data

Feb. 19, 2020 (JP) ..... JP2020-025865

(51) Int. Cl.
*G03G 21/00* (2006.01)
*G03G 15/00* (2006.01)
*G03G 21/16* (2006.01)

(52) U.S. Cl.
CPC ..... *G03G 21/007* (2013.01); *G03G 15/75* (2013.01); *G03G 21/0058* (2013.01); *G03G 21/169* (2013.01); *G03G 21/1652* (2013.01); *G03G 2221/0047* (2013.01); *G03G 2221/0068* (2013.01); *G03G 2221/0073* (2013.01)

(58) Field of Classification Search
CPC .. G03G 15/75; G03G 21/0058; G03G 21/007; G03G 21/1652; G03G 21/169; G03G 2221/0047; G03G 2221/0068; G03G 2221/0073
See application file for complete search history.

(56) References Cited

U.S. PATENT DOCUMENTS

2009/0169234 A1 7/2009 Kamimura
2010/0135689 A1* 6/2010 Abe ..... G03G 21/1671 399/90
2015/0037060 A1* 2/2015 Hamaya ..... G03G 21/1867 399/90
2015/0277358 A1* 10/2015 Abe ..... G03G 21/1867 399/90

FOREIGN PATENT DOCUMENTS

JP 2009-162911 A 7/2009

* cited by examiner

*Primary Examiner* — Joseph S Wong
(74) *Attorney, Agent, or Firm* — Merchant & Gould P.C.

(57) ABSTRACT

A photosensitive drum rotates about a first axis extending in a first direction. A photosensitive drum is located at one end portion of a housing in a second direction. A cleaning roller cleans a surface of the photosensitive drum. The cleaning roller rotates about a second axis extending in the first direction. A cleaning electrode is electrically connected to the cleaning roller. The cleaning electrode is located at an outer surface of the housing in the first direction. The cleaning electrode is located at a tip end of the one end portion of the housing in the second direction. The cleaning electrode includes a contact surface and a guide surface. The contact surface contacts an electrical contact to which a voltage is supplied. The contact surface is perpendicular to the first direction. The guide surface guides the electrical contact to the contact surface when the drum cartridge is mounted.

13 Claims, 8 Drawing Sheets

DRUM CARTRIDGE AND IMAGE FORMING APPARATUS

CROSS REFERENCE TO RELATED APPLICATIONS

This application claims priority from Japanese Patent Application No. 2020-025865 filed Feb. 19, 2020. The entire content of the priority application is incorporated herein by reference.

TECHNICAL FIELD

This disclosure relates to a drum cartridge having a cleaning roller and an image forming apparatus.

BACKGROUND

A drum cartridge having a cleaning roller is known. In this drum cartridge, the surface of a photosensitive drum is cleaned by the cleaning roller.

SUMMARY

According to one aspect, this specification discloses a drum cartridge. The drum cartridge includes a housing, a photosensitive drum, a cleaning roller, and a cleaning electrode. The photosensitive drum is rotatable about a first axis extending in a first direction. The photosensitive drum is located at one end portion of the housing in a second direction intersecting the first direction. The cleaning roller is configured to clean a surface of the photosensitive drum. The cleaning roller is rotatable about a second axis extending in the first direction. The cleaning electrode is electrically connected to the cleaning roller. The cleaning electrode is located at an outer surface of the housing in the first direction. The cleaning electrode is located at a tip end of the one end portion of the housing in the second direction. The cleaning electrode includes a contact surface and a guide surface. The contact surface is configured to contact an electrical contact to which a voltage is supplied. The contact surface is perpendicular to the first direction. The guide surface is configured to guide the electrical contact to the contact surface when the drum cartridge is mounted.

According to another aspect, this specification also discloses an image forming apparatus configured such that a drum cartridge is mounted thereon. The drum cartridge includes a housing, a photosensitive drum, a cleaning roller, a cleaning electrode, a charger, and a guide wall. The photosensitive drum is rotatable about a first axis extending in a first direction. The photosensitive drum is located at one end portion of the housing in a second direction intersecting the first direction. The cleaning roller is configured to clean a surface of the photosensitive drum. The cleaning roller is rotatable about a second axis extending in the first direction. The cleaning electrode is electrically connected to the cleaning roller. The cleaning electrode is located at an outer surface of the housing in the first direction. The cleaning electrode is located at a tip end of the one end portion of the housing in the second direction. The cleaning electrode includes a contact surface and a guide surface. The contact surface is configured to contact an electrical contact to which a voltage is supplied. The contact surface is perpendicular to the first direction. The guide surface is configured to guide the electrical contact to the contact surface when the drum cartridge is mounted. The charger is configured to charge the surface of the photosensitive drum. The charger includes a charging wire, a grid, and a grid electrode configured to apply a voltage to the grid and located at an outer surface of the housing in the first direction. The guide wall is located between the cleaning electrode and the grid electrode in the first direction. The guide wall is inclined to be away from the roller portion in the first direction toward the grid electrode in the second direction. The image forming apparatus includes a main housing, a first electrical contact, and a second electrical contact. The first electrical contact is configured to contact the cleaning electrode when the drum cartridge is mounted on the main housing. The second electrical contact is configured to contact the grid electrode when the drum cartridge is mounted on the main housing. When the drum cartridge is mounted onto the main housing, the guide surface is configured to guide the second electrical contact toward the guide wall in a case where the guide surface contacts the second electrical contact; the guide wall is configured to guide the second electrical contact toward the grid electrode in a case where the guide wall contacts the second electrical contact; and the guide surface is configured to guide the first electrical contact toward the contact surface in a case where the guide surface contacts the first electrical contact. When the second electrical contact contacts the grid electrode, the cleaning electrode contacts the first electrical contact.

BRIEF DESCRIPTION OF THE DRAWINGS

Embodiments in accordance with this disclosure will be described in detail with reference to the following figures wherein:

FIGS. 7A to 7C are diagrams showing a mount operation of the drum cartridge, wherein FIG. 7A shows a state where the second electrical contact is in contact with the cleaning electrode, FIG. 7B shows a state where the second electrical contact is in contact with a guide wall, and FIG. 7C shows a state where the mount operation is finished; and FIGS. 8A and 8B are diagrams showing a mount operation of the drum cartridge, wherein FIG. 8A shows a state where the drum cartridge is mounted in a forward tilted posture, and FIG. 8B shows a state where the drum cartridge is mounted in a rearward tilted posture.

DETAILED DESCRIPTION

A voltage is applied to a cleaning roller to clean the surface of a photosensitive drum. For this reason, a drum cartridge includes a cleaning electrode for supplying voltage to the cleaning roller. The cleaning electrode includes a contact surface that contacts the electrical contact of the main body of the image forming apparatus, and it is required that the electrical contact smoothly contact the contact surface.

In view of the foregoing, an aspect of an objective of this disclosure is to provide a drum cartridge and an image forming apparatus in which an electrical contact smoothly contacts a contact surface of a cleaning electrode.

Next, an embodiment of the present disclosure will be described in detail with reference to the drawings as appropriate. In the following description, the axial direction of a photosensitive drum 51 is referred to as "first direction".

Figure 1:
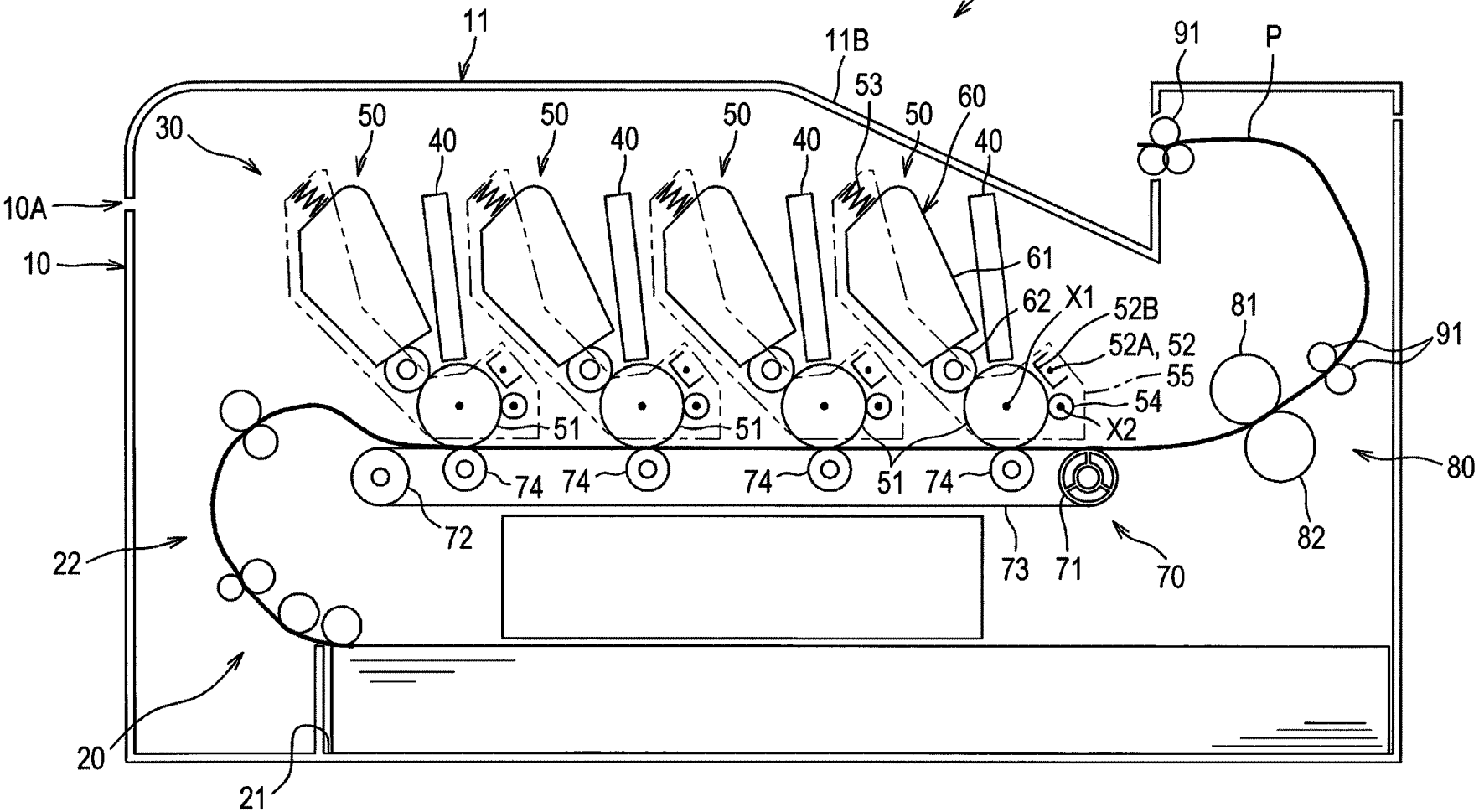
FIG. 1 is a diagram showing the schematic configuration of an image forming apparatus according to an embodiment of this disclosure.

As shown in FIG. 1, the image forming apparatus 1 is a color printer. The image forming apparatus 1 includes a main housing 10, a top cover 11, a paper feed unit 20, and an image forming unit 30.

The top cover 11 opens and closes an opening 10A formed in the upper part of the main housing 10. The top cover 11 is arranged at the upper part of the main housing 10. The top cover 11 is rotatably provided at the main housing 10 about a rotation shaft 11A (see FIG. 2). The upper surface of the top cover 11 serves as a paper discharge tray 11B on which discharged paper P is placed.

The paper feed unit 20 is provided at the lower part of the main housing 10. The paper feed unit 20 includes a paper feed tray 21 that accommodates paper P, and a paper feed mechanism 22 that supplies the paper P from the paper feed tray 21 to the image forming unit 30. The paper P in the paper feed tray 21 is separated one sheet at a time and supplied to the image forming unit 30 by the paper feed mechanism 22.

The image forming unit 30 includes four exposure heads 40, four drum cartridges 50, a transfer unit 70, and a fixing unit 80.

The exposure head 40 has a plurality of LEDs. The exposure head 40 is held by the top cover 11 so as to be suspended from the top cover 11. The exposure head 40 exposes the surface of the photosensitive drum 51 by blinking a plurality of LEDs based on image data.

Figure 2:
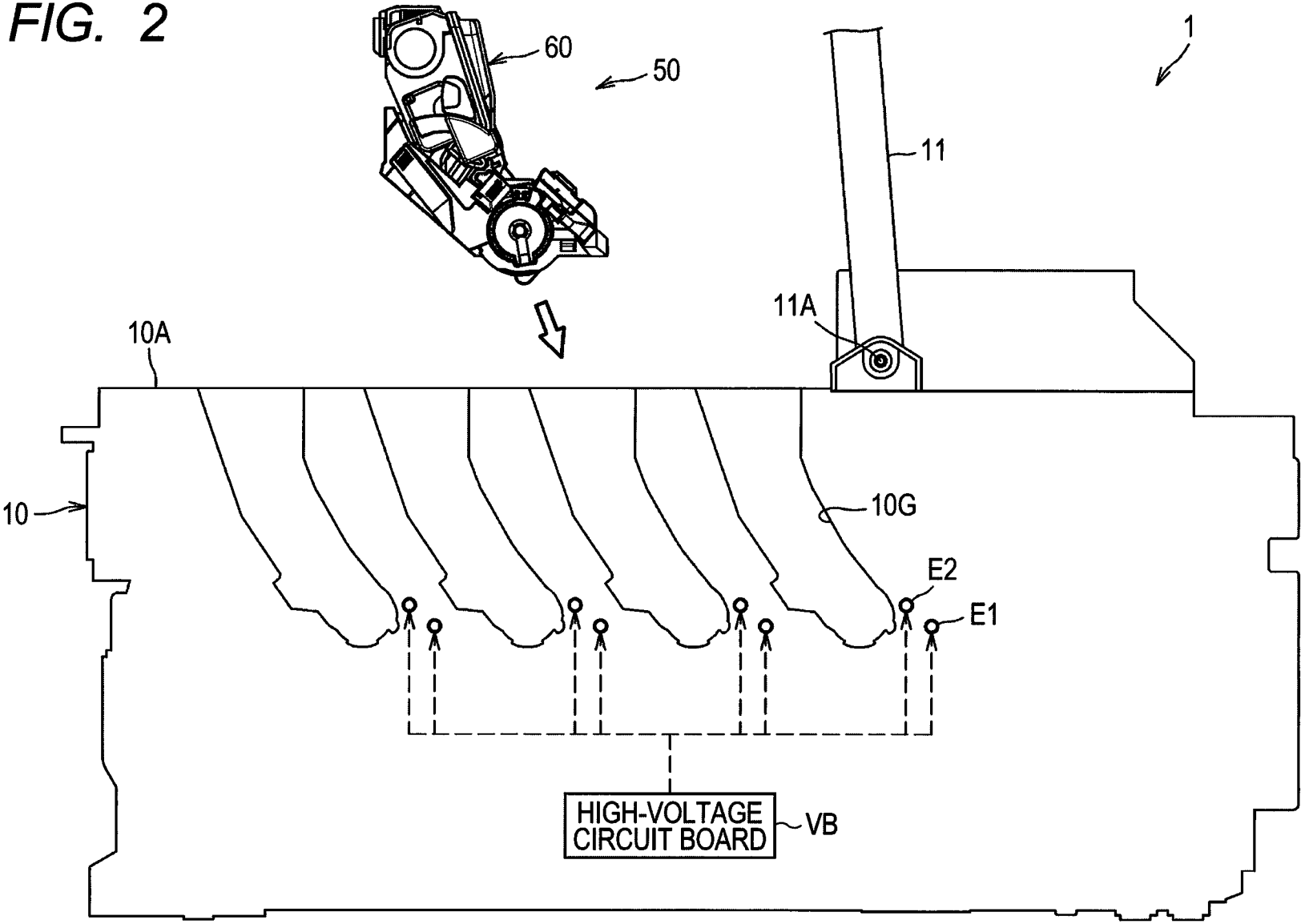
FIG. 2 is a diagram showing the state where a cover of the image forming apparatus is opened and a drum cartridge is taken out.

The image forming apparatus 1 is configured such that drum cartridges 50 are mounted thereon. Specifically, as shown in FIG. 2, each drum cartridge 50 is configured to be attached and detached through the opening 10A of the main housing 10 in a state where the top cover 11 is opened. The drum cartridge 50 is guided by a mounting guide 10G formed on the main housing 10.

As shown in FIG. 1, each drum cartridge 50 is located between the top cover 11 and the paper feed tray 21 when mounted on the main housing 10. A development cartridge 60 is configured to be mounted on each drum cartridge 50. The drum cartridge 50 is mounted on the main housing 10 in a state where the development cartridge 60 is mounted.

The drum cartridge 50 includes a photosensitive drum 51, a charger 52, a pressing spring 53, a cleaning roller 54, and a housing 55.

Figure 3:
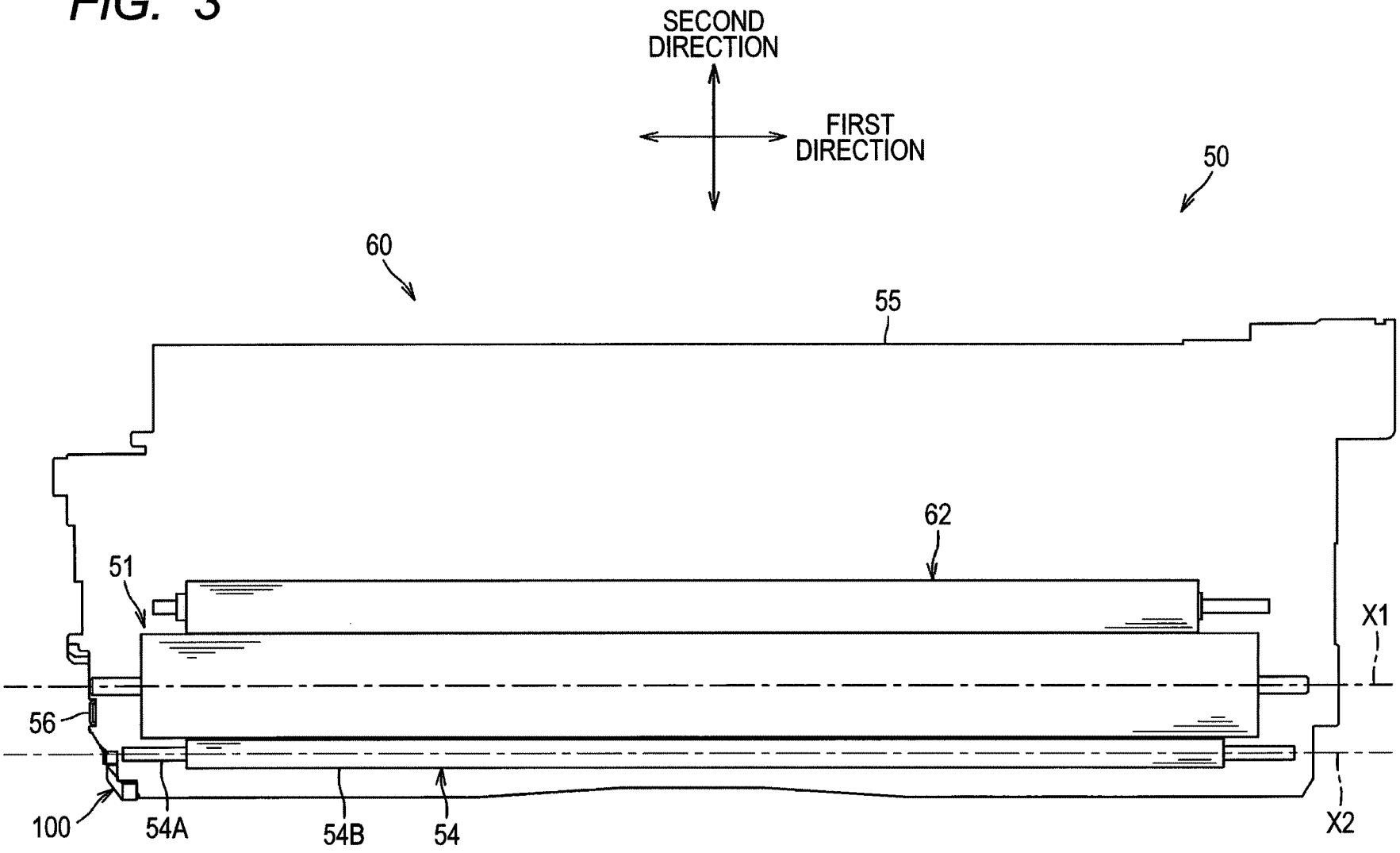
FIG. 3 is a diagram showing the positions of a photosensitive drum, a cleaning roller, and a cleaning electrode.

The photosensitive drum 51 is rotatable about a first axis X1 extending in the first direction. As shown in FIG. 3, the photosensitive drum 51 is located at one end portion of the housing 55 in a second direction intersecting the first direction. In this embodiment, the second direction is a direction perpendicular to the first direction. The second direction is the mounting (attachment) and dismounting (detachment) direction of the drum cartridge 50, for example, but the second direction is not limited to the mounting and dismounting direction.

As shown in FIG. 1, the charger 52 charges the surface of the photosensitive drum 51. The charger 52 has a charging wire 52A and a grid 52B. The charging wire 52A is a wire made of metal. The charging wire 52A is provided along the first direction. The grid 52B is a metal plate member formed with a plurality of slits. The grid 52B is provided between the charging wire 52A and the photosensitive drum 51.

The pressing spring 53 urges the development cartridge 60 toward the photosensitive drum 51. The housing 55 supports the photosensitive drum 51 and the cleaning roller 54 so as to be rotatable.

The cleaning roller 54 is a roller that cleans the surface of the photosensitive drum 51. The cleaning roller 54 is rotatable about a second axis X2 extending in the first direction. The cleaning roller 54 is rotatable in contact with the photosensitive drum 51. A voltage is applied to the cleaning roller 54. This makes it possible to move foreign matters adhering to the photosensitive drum 51 onto the cleaning roller 54 due to the potential difference. As shown in FIG. 3, the cleaning roller 54 includes a shaft 54A and a roller portion 54B. The shaft 54A extends in the first direction. The roller portion 54B covers the outer peripheral surface of the shaft 54A.

As shown in FIG. 1, the development cartridge 60 includes a development housing 61 and a developing roller 62. The development housing 61 accommodates toner. The developing roller 62 supplies the toner in the development housing 61 to the photosensitive drum 51. The developing roller 62 is rotatable while being pressed against the photosensitive drum 51 by the pressing spring 53.

The transfer unit 70 is located between the paper feed tray 21 and the drum cartridge 50. The transfer unit 70 includes a drive roller 71, a follow roller 72, an endless conveyance belt 73, and four transfer rollers 74. The drive roller 71 and the follow roller 72 support the conveyance belt 73.

The conveyance carrying belt 73 is a belt that conveys the paper P. The outer surface of the conveyance belt 73 is in contact with the photosensitive drums 51. Each transfer roller 74 sandwiches the conveyance belt 73 with the corresponding photosensitive drum 51.

The fixing unit 80 includes a heating roller 81 and a pressure roller 82. The pressure roller 82 is pressed by the heating roller 81.

In this image forming unit 30, the charger 52 first charges the surface of the photosensitive drum 51. After that, the exposure head 40 exposes the surface of the photosensitive drum 51 to light. As a result, an electrostatic latent image is formed on the photosensitive drum 51.

The developing roller 62 then supplies toner to the electrostatic latent image on the photosensitive drum 51. As a result, a toner image is formed on the photosensitive drum 51.

As the paper P passes between the conveyance belt 73 and the photosensitive drum 51, the toner image on the photosensitive drum 51 is transferred onto the paper P. After that, the toner image on the paper P is fixed by the fixing unit 80. Then, the paper P is discharged to the paper discharge tray 11B by the discharge roller 91.

Next, a configuration for the image forming apparatus 1 to apply a voltage to the grid 52B and the cleaning roller 54 will be described.

As shown in FIGS. 2 and 3, the image forming apparatus 1 further includes a high voltage circuit board VB, a first electrical contact E1, and a second electrical contact E2. In the present embodiment, four first electrical contacts E1 and four second electrical contacts E2 are provided so as to correspond to the four drum cartridges 50. The drum cartridge 50 has a grid electrode 56 and a cleaning electrode 100.

The high voltage circuit board VB is configured to output a voltage. Although only the structure in which a voltage is supplied from the high voltage circuit board VB to the grid 52B and the cleaning roller 54 is illustrated in FIGS. 2 and 3, a voltage is also supplied from the high voltage circuit board VB to other members.

Figure 4:
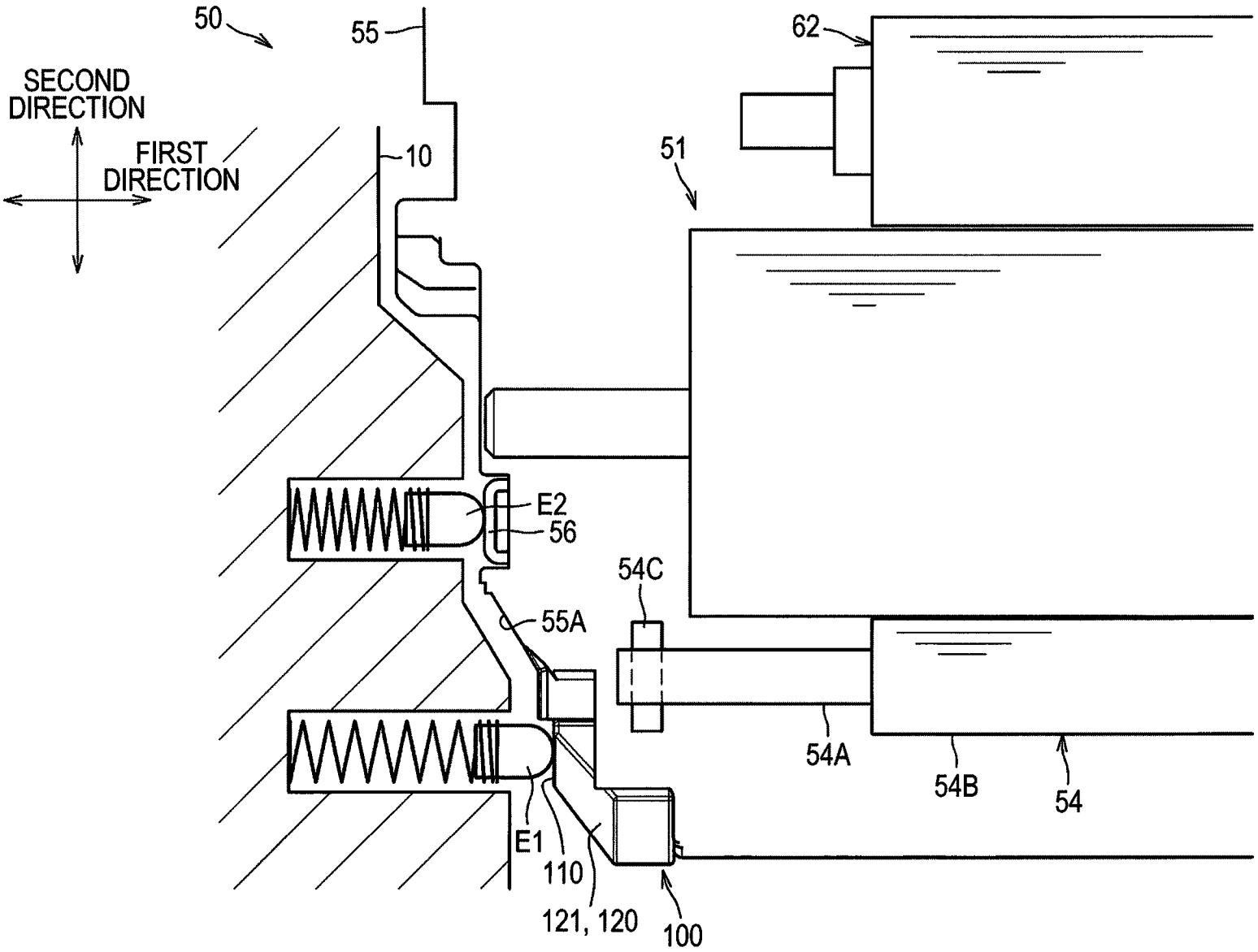
FIG. 4 is a diagram showing the positions of a grid electrode, a cleaning electrode, a first electrical contact, and a second electrical contact.

As shown in FIG. 4, the first electrical contact E1 is provided at a position where the drum cartridge 50 contacts the cleaning electrode 100 when the drum cartridge 50 is mounted on the apparatus main body 10. The first electrical contact E1 is connected to the high voltage circuit board VB. The first electrical contact E1 is urged toward the drum cartridge 50 by an urging member such as a coil spring. When the first electrical contact E1 contacts the cleaning electrode 100, a voltage is applied from the high voltage circuit board VB to the cleaning roller 54.

The second electrical contact E2 is provided at a position where the drum cartridge 50 contacts the grid electrode 56 when the drum cartridge 50 is mounted on the apparatus main body 10. The second electrical contact E2 is connected to the high voltage circuit board VB. The second electrical contact E2 is urged toward the drum cartridge 50 by an urging member such as a coil spring. When the second electrical contact E2 contacts the grid electrode 56, a voltage is applied from the high voltage circuit board VB to the grid 52B.

The grid electrode 56 is an electrode that contacts the second electrical contact E2 and applies a voltage to the grid 52B. The grid electrode 56 is electrically connected to the grid 52B (not shown). The grid electrode 56 is located at the outer surface of the housing 55 in the first direction.

The cleaning electrode 100 is an electrode that contacts the first electrical contact E1 to which a voltage is supplied from the high voltage circuit board VB and applies a voltage to the cleaning roller 54. The cleaning electrode 100 is made from an electrically-conductive resin. The cleaning electrode 100 is made from a polyacetal resin, for example.

The cleaning electrode 100 is located at the outer surface of the housing 55 in the first direction. The cleaning electrode 100 is located at the tip end of one end of the housing 55 in the second direction. The tip end of the cleaning electrode 100 protrudes in the second direction from the housing 55. The one end of the housing 55 in the second direction is the downstream end of the housing 55 in the mounting direction of the drum cartridge 50.

The cleaning electrode 100 is connected to one end of the shaft 54A. Specifically, the drum cartridge 50 has a conductive member 54C. The cleaning electrode 100 is connected to one end of the shaft 54A via the conductive member 54C (see FIG. 5). As a result, the cleaning electrode 100 is electrically connected to the cleaning roller 54.

Figure 5:
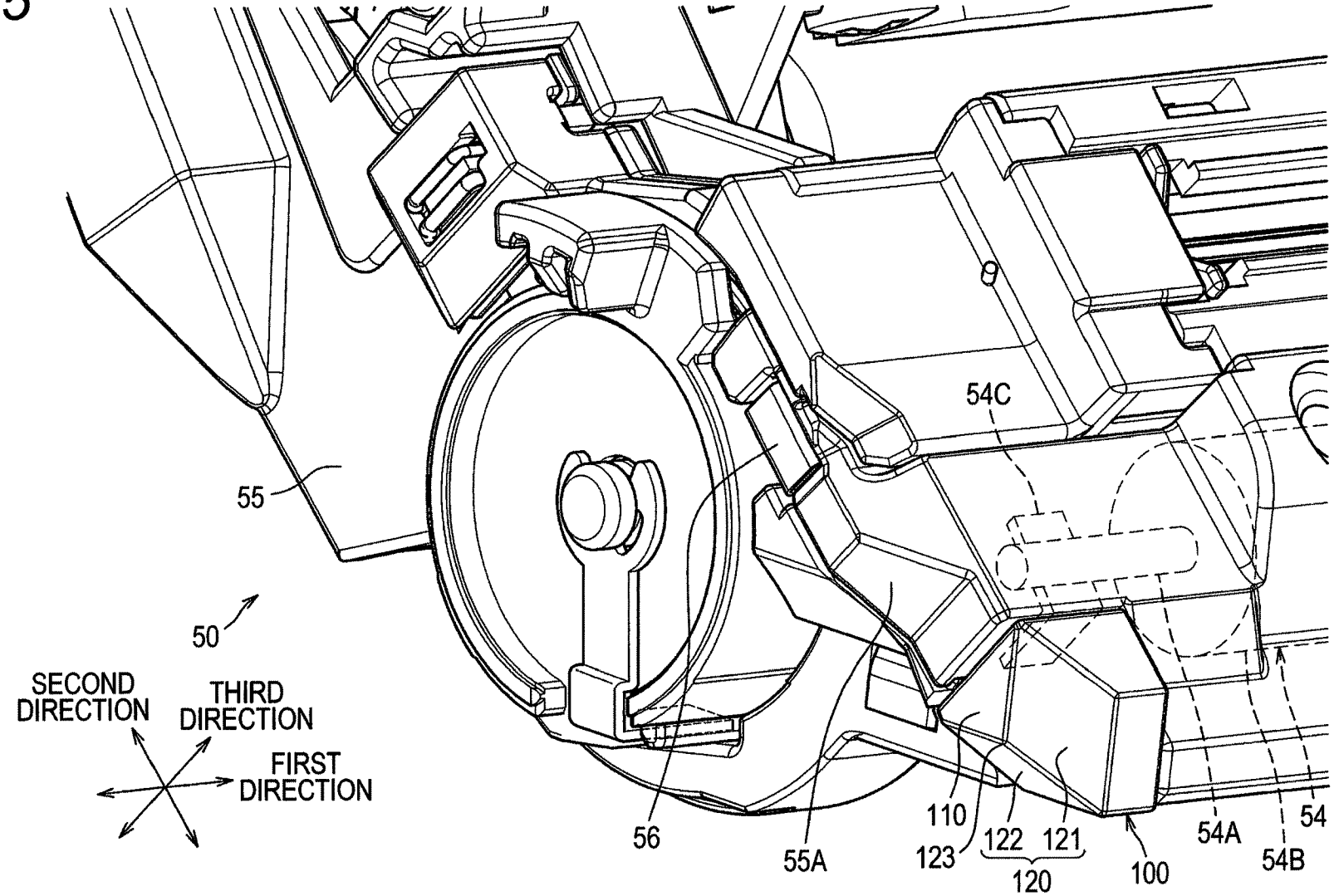
FIG. 5 is an enlarged perspective view around the cleaning electrode.

As shown in FIG. 5, the cleaning electrode 100 has a contact surface 110 and a guide surface 120.

The contact surface 110 is a surface that contacts the first electrical contact E1 when the drum cartridge 50 is mounted on the apparatus main body 10. The contact surface 110 is a surface perpendicular to the first direction. The width of the contact surface 110 in a third direction increases as it approaches the other end in the second direction (that is, the width of the contact surface 110 in the third direction increases in a direction toward the other end in the second direction, that is, toward the upstream end in the mounting direction of the drum cartridge 50). In the present embodiment, the contact surface 110 has a triangular shape. The third direction is a direction intersecting the second direction and the first direction. In the present embodiment, the third direction is a direction perpendicular to the first direction and the second direction.

The guide surface 120 is a surface for guiding the first electrical contact E1 to the contact surface 110 when the drum cartridge 50 is mounted.

The guide surface 120 is inclined with respect to the contact surface 110 so as to approach the roller portion 54B in the first direction as it approaches the tip end of one end of the housing 55 in the second direction (that is, the guide surface 120 is inclined with respect to the contact surface 110 so as to approach the roller portion 54B in the first direction, in a direction toward the tip end of one end of the housing 55 in the second direction). The guide surface 120 has a first inclined surface 121 and a second inclined surface 122.

Figure 6:
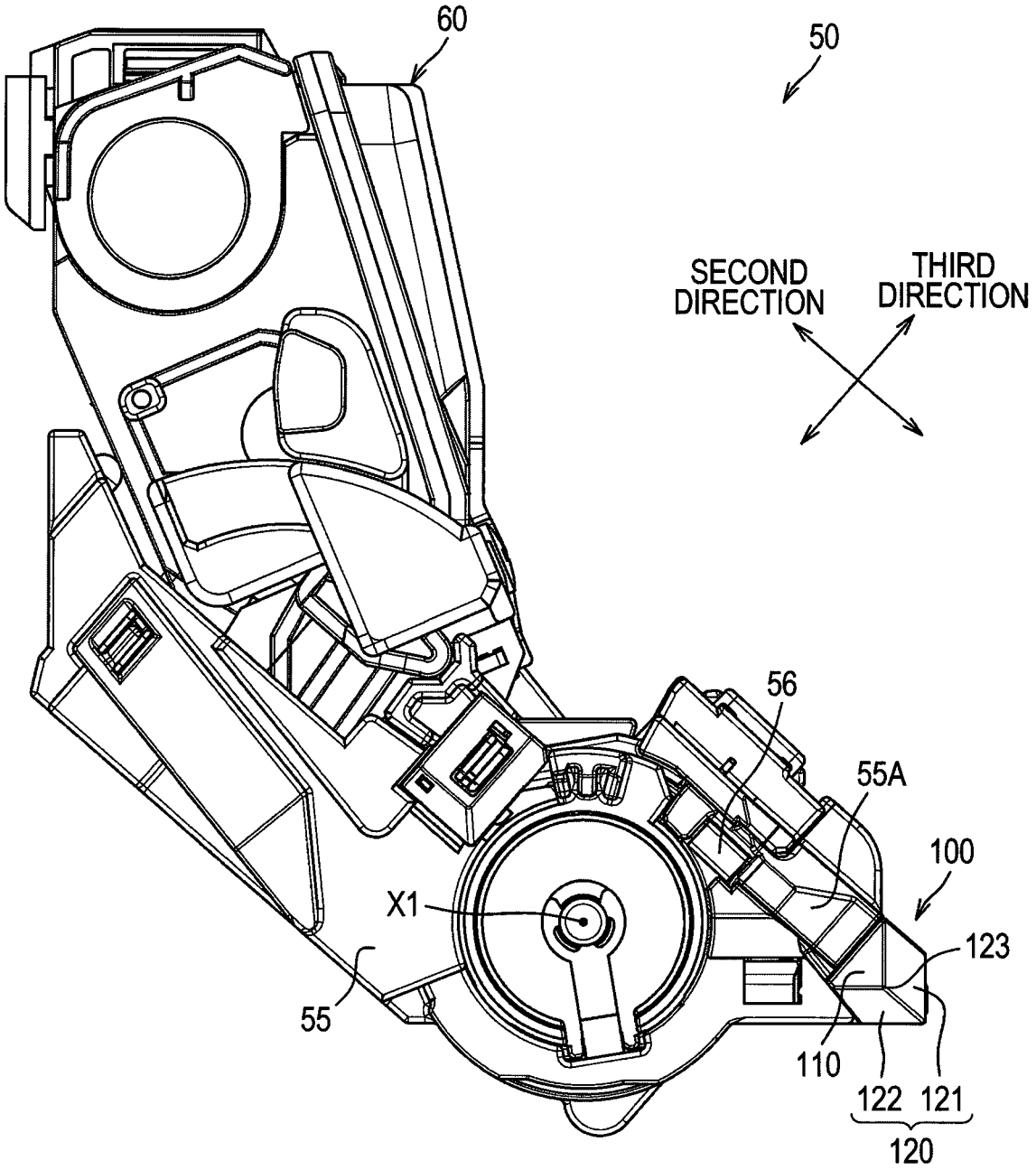
FIG. 6 is a diagram of the drum cartridge as viewed from an axial direction.

The first inclined surface 121 is inclined with respect to the contact surface 110 so as to approach the roller portion 54B in the first direction as it approaches one end side of the third direction intersecting the first direction and the second direction (that is, the first inclined surface 121 is inclined with respect to the contact surface 110 so as to approach the roller portion 54B in the first direction, in a direction toward one end side of the third direction). Further, the first inclined surface 121 approaches the second inclined surface 122 as it separates away from the roller portion 54B in the first direction (that is, the first inclined surface 121 approaches the second inclined surface 122 in a direction away from the roller portion 54B in the first direction). In the present embodiment, the first inclined surface 121 is a quadrangle, one side of the quadrangle being in contact with the contact surface 110, and another side being in contact with the second inclined surface 122 (see FIG. 6).

The second inclined surface 122 is inclined with respect to the contact surface 110 so as to approach the roller portion 54B in the first direction as it approaches the other end side opposite to the one end side in the third direction (that is, the second inclined surface 122 is inclined with respect to the contact surface 110 so as to approach the roller portion 54B in the first direction, in a direction toward the other end side in the third direction). The second inclined surface 122 approaches the first inclined surface 121 as it separates away from the roller portion MB in the first direction (that is, the second inclined surface 122 approaches the first inclined surface 121 in a direction away from the roller portion 54B in the first direction). In the present embodiment, the second inclined surface 122 is a quadrangle, one side of the quadrangle being in contact with the contact surface 110, and another side being in contact with the first inclined surface 121 (see FIG. 6). The three surfaces of the contact surface 110, the first inclined surface 121, and the second inclined surface 122 intersect at a vertex 123 (see FIG. 5).

The drum cartridge 50 further includes a guide wall 55A. The guide wall 55A is a portion that guides the second electrical contact E2 toward the grid electrode 56 when the drum cartridge 50 is mounted. The guide wall 55A is formed integrally with the housing 55 and is located at the outer surface of the housing 55 in the first direction. The guide wall 55A is located between the cleaning electrode 100 and the grid electrode 56 in the first direction. Further, the guide wall 55A is located between the cleaning electrode 100 and the grid electrode 56 in the second direction. The guide wall 55A is inclined to be away from the roller portion 54B in the first direction as it approaches the grid electrode 56 in the second direction (that is, the guide wall 55A is inclined to be away from the roller portion 54B in the first direction, in a direction toward the grid electrode 56 in the second direction).

Next, the operation when the drum cartridge 50 is attached (mounted) to the apparatus main body 10 of the image forming apparatus 1 will be described with reference to FIGS. 7A to 8B.

Figure 7A:
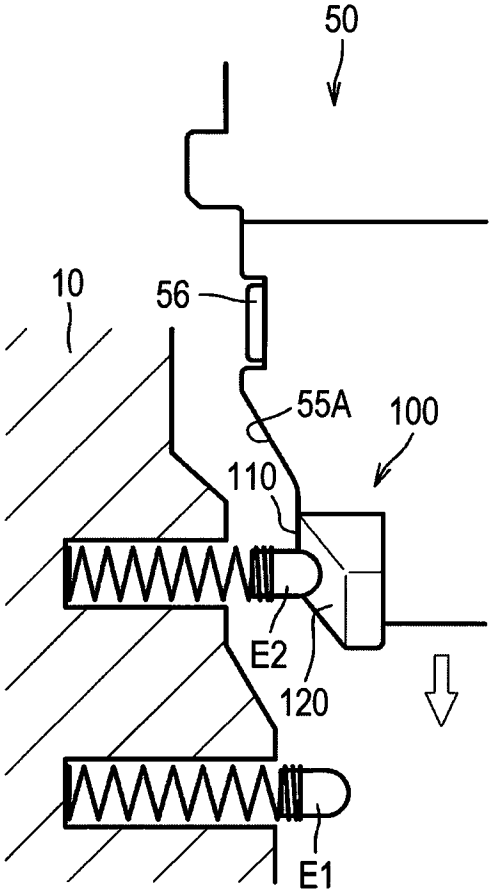

As shown in FIG. 7A, when the drum cartridge 50 is mounted on the apparatus main body 10, the guide surface 120 of the cleaning electrode 100, that is, the first inclined surface 121 or the second inclined surface 122 may contact the second electrical contact E2.

Figure 8A:
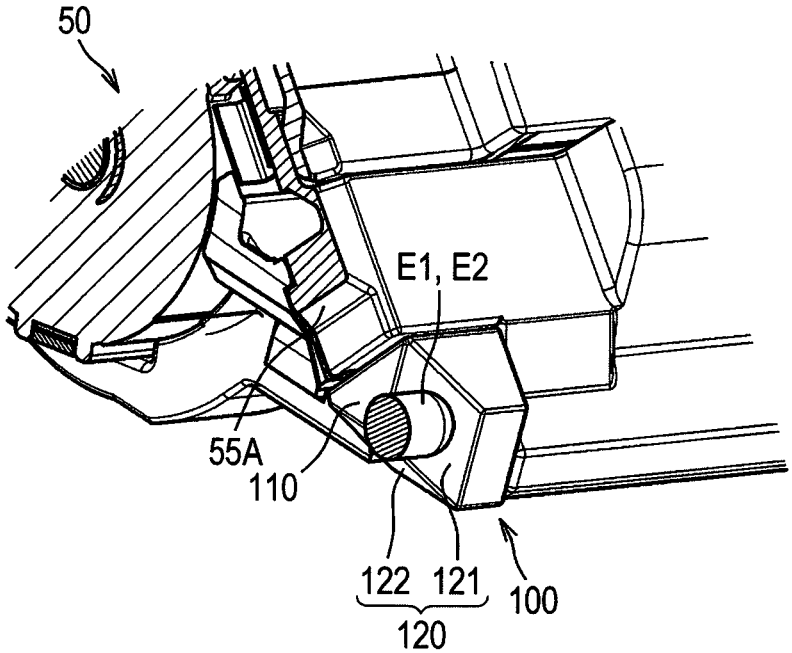

As shown in FIG. 8A, when the drum cartridge 50 is mounted in a forward tilted state, that is, in a state where the cartridge is too erect, the first inclined surface 121 may contact the second electrical contact E2. When the first inclined surface 121 contacts the second electrical contact E2, the first inclined surface 121 guides the second electrical contact E2 toward the guide wall 55A.

Figure 8B:
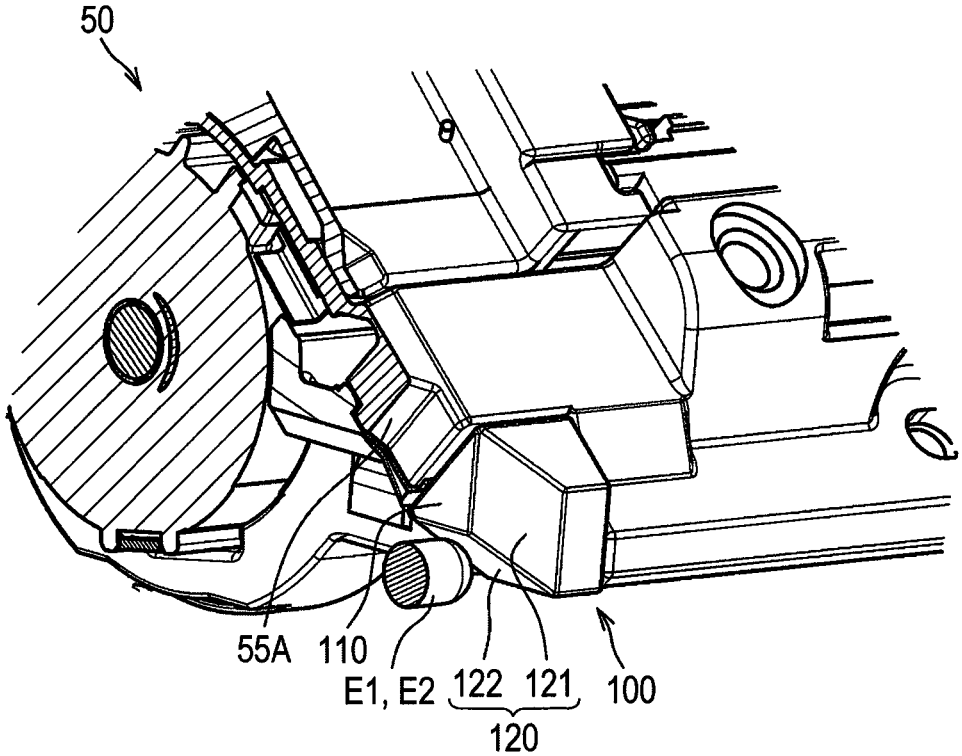

As shown in FIG. 8B when the drum cartridge 50 is mounted in a rearward tilted state, that is, in a state where the cartridge is tilted too much, the second inclined surface 122 may contact the second electrical contact E2. When the second inclined surface 122 contacts the second electrical contact E2, the second inclined surface 122 guides the second electrical contact E2 toward the guide wall 55A.

Figure 7B:
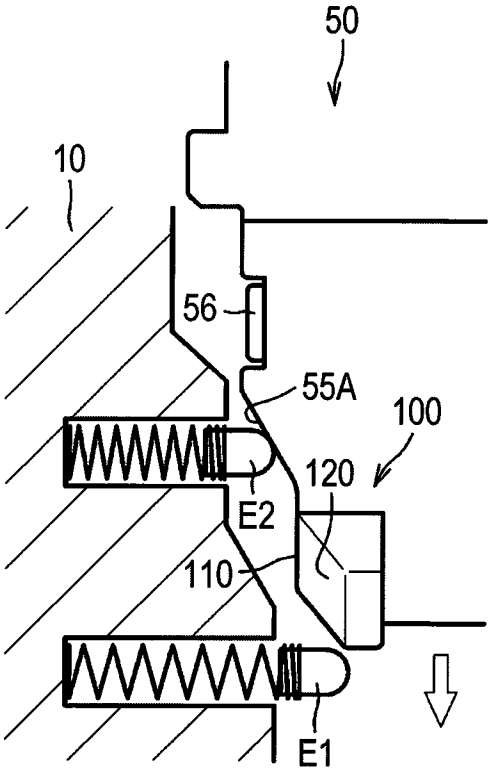

As shown in FIG. 7B, when the drum cartridge 50 is mounted on the apparatus main body 10, the guide wall 55A may contact the second electrical contact E2. When the guide wall 55A contacts the second electrical contact E2, the guide wall 55A guides the second electrical contact E2 toward the grid electrode 56.

When the drum cartridge 50 is mounted on the apparatus main body 10, the guide surface 120 of the cleaning electrode 100, that is, the first inclined surface 121 or the second inclined surface 122 may contact the first electrical contact E1.

As shown in FIG. 8A, when the drum cartridge 50 is mounted in a forward tilted state, that is, in a state where the cartridge is too erect, the first inclined surface 121 may contact the first electrical contact E1. When the first inclined surface 121 contacts the first electrical contact E1, the first inclined surface 121 guides the first electrical contact E1 toward the contact surface 110.

As shown in FIG. 8B, when the drum cartridge 50 is mounted in a rearward tilted state, that is, in a state where the cartridge is tilted too much, the second inclined surface 122 may contact the first electrical contact E1. When the second inclined surface 122 contacts the first electrical contact E1, the second inclined surface 122 guides the first electrical contact E1 toward the contact surface 110.

Figure 7C:
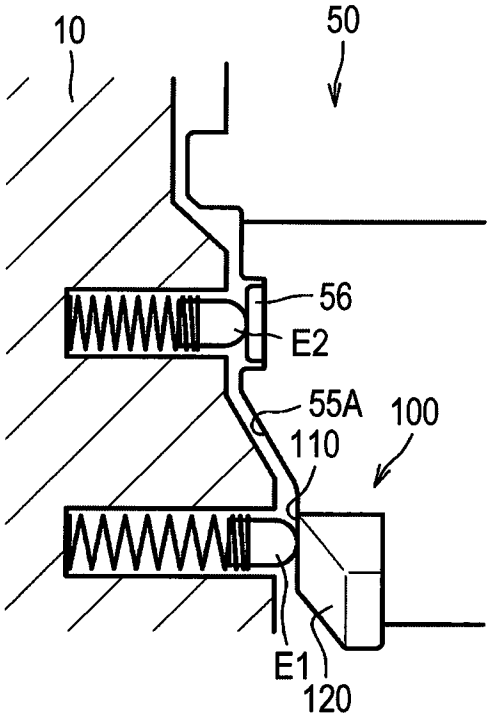

As shown in FIG. 7C when the drum cartridge 50 is mounted on the apparatus main body 10, the second electrical contact E2 contacts the grid electrode 56, and the cleaning electrode 100 contacts the first electrical contact E1.

Based on the above, the following effects are obtained in the present embodiment.

The drum cartridge 50 includes the cleaning electrode 100 having the contact surface 110 that contacts the first electrical contact E1 and the guide surface 120 that guides the first electrical contact E1 to the contact surface 110. As a result, when the drum cartridge 50 is mounted on the image forming apparatus 1 since the guide surface 120 of the cleaning electrode 100 guides the first electrical contact E1 toward the contact surface 110, the electrical contact E1 smoothly contacts the contact surface 110 of the cleaning electrode 100.

The guide surface 120 of the cleaning electrode 100 is inclined with respect to the contact surface 110 so as to approach the roller portion 54B of the cleaning roller 54 in the first direction as it approaches the tip end in the second direction (that is, the guide surface 120 of the cleaning electrode 100 is inclined with respect to the contact surface 110 so as to approach the roller portion 54B of the cleaning roller 54 in the first direction in a direction toward the tip end in the second direction). Therefore, when the drum cartridge 50 is mounted on the image forming apparatus 1, even if the drum cartridge 50 is slightly displaced in the first direction, since the guide surface 120 of the cleaning electrode 100 guides the first electrical contact E1 toward the contact surface 110, the first electrical contact E1 smoothly contacts the contact surface 110 of the cleaning electrode 100.

The guide surface 120 has the first inclined surface 121 and the second inclined surface 122. Thus, when the drum cartridge 50 is mounted on the image forming apparatus 1, even if the drum cartridge 50 is slightly displaced in the third direction, since the first inclined surface 121 or the second inclined surface 122 guides the first electrical contact E1, the first electrical contact E1 smoothly contacts the contact surface 110 of the cleaning electrode 100.

The drum cartridge 50 further includes the guide wall 55A that is located between the cleaning electrode 100 and the grid electrode 56 and that is inclined so as to approach the roller portion 54B in the first direction as it approaches the roller portion 54B in the second direction (that is, the guide wall 55A is inclined so as to approach the roller portion 54B in the first direction in a direction toward the roller portion 54B in the second direction). Therefore, when the drum cartridge 50 is mounted, since the guide wall 55A guides the second electrical contact E2 toward the grid electrode 56, the second electrical contact E2 smoothly contacts the grid electrode 100.

While the disclosure has been described in detail with reference to the above aspects thereof, it would be apparent to those skilled in the art that various changes and modifications may be made therein without departing from the scope of the claims.

In the above embodiment, the cleaning roller 54 contacts the photosensitive drum 51. However, the cleaning roller 54 may not contact the photosensitive drum 51.

The elements described in the above embodiments and modifications may be combined as appropriate.

What is claimed is:

1. A drum cartridge comprising:

a housing;

a photosensitive drum rotatable about a first axis extending in a first direction, the photosensitive drum being located at one end portion of the housing in a second direction intersecting the first direction;

a cleaning roller configured to clean a surface of the photosensitive drum, the cleaning roller rotatable about a second axis extending in the first direction; and a cleaning electrode electrically connected to the cleaning roller, the cleaning electrode being located at an outer surface of the housing in the first direction, the cleaning electrode being located at a tip end of the one end portion of the housing in the second direction, the cleaning electrode including:

a contact surface configured to contact an electrical contact to which a voltage is supplied, the contact surface being perpendicular to the first direction; and a guide surface configured to guide the electrical contact to the contact surface when the drum cartridge is mounted.

2. The drum cartridge according to claim 1, wherein the drum cartridge is configured such that a development cartridge is mounted thereon, the development cartridge including a developing roller and a development housing configured to contain toner.

3. The drum cartridge according to claim 1, wherein the cleaning roller includes a roller portion and a shaft extending in the first direction;

wherein the cleaning electrode is connected to one end of the shaft; and wherein the guide surface is inclined relative to the contact surface so as to approach the roller portion in the first direction toward the tip end in the second direction.

4. The drum cartridge according to claim 3, wherein the guide surface includes:

a first inclined surface that is inclined relative to the contact surface so as to approach the roller portion in the first direction toward one end side in a third direction intersecting the second direction and the first direction; and a second inclined surface that is inclined relative to the contact surface so as to approach the roller portion in the first direction toward an other end side in the third direction, the other end side being opposite the one end side.

5. The drum cartridge according to claim 4, wherein the first inclined surface approaches the second inclined surface in a direction away from the roller portion in the first direction; and wherein the second inclined surface approaches the first inclined surface in a direction away from the roller portion in the first direction.

6. The drum cartridge according to claim 1, wherein a width of the contact surface in a third direction increases toward an other end in the second direction, the third direction intersecting the first direction and the second direction.

7. The drum cartridge according to claim 1, wherein the cleaning electrode is made of an electrically-conductive resin.

8. The drum cartridge according to claim 1, further comprising a charger configured to charge the surface of the photosensitive drum, the charger including a charging wire, a grid, and a grid electrode configured to apply a voltage to the grid and located at an outer surface of the housing in the first direction.

9. The drum cartridge according to claim 8, further comprising a guide wall located between the cleaning electrode and the grid electrode in the first direction, the guide wall being inclined to be away from the roller portion in the first direction toward the grid electrode in the second direction.

10. The drum cartridge according to claim 1, wherein the second direction is a mounting and dismounting direction of the drum cartridge in which the drum cartridge is mounted onto and dismounted from an image forming apparatus.

11. The drum cartridge according to claim 1 wherein the cleaning electrode protrudes in the second direction from the housing.

12. The drum cartridge according to claim 6, wherein the contact surface has a triangular shape;

wherein the guide surface includes a first inclined surface and a second inclined surface;

wherein the first inclined surface has a quadrangle shape, one side of the quadrangle shape being in contact with the contact surface, and another side being in contact with the second inclined surface;

wherein the second inclined surface has a quadrangle shape, one side of the quadrangle shape being in contact with the contact surface, and another side being in contact with the first inclined surface; and wherein three surfaces of the contact surface, the first inclined surface, and the second inclined surface intersect at a vertex.

13. An image forming apparatus configured such that a drum cartridge is mounted thereon, the drum cartridge comprising:

a housing;

a photosensitive drum rotatable about a first axis extending in a first direction, the photosensitive drum being located at one end portion of the housing in a second direction intersecting the first direction;

a cleaning roller configured to clean a surface of the photosensitive drum, the cleaning roller rotatable about a second axis extending in the first direction;

a cleaning electrode electrically connected to the cleaning roller, the cleaning electrode being located at an outer surface of the housing in the first direction, the cleaning electrode being located at a tip end of the one end portion of the housing in the second direction, the cleaning electrode including:

a contact surface configured to contact an electrical contact to which a voltage is supplied, the contact surface being perpendicular to the first direction; and a guide surface configured to guide the electrical contact to the contact surface when the drum cartridge is mounted;

a charger configured to charge the surface of the photosensitive drum, the charger including a charging wire, a grid, and a grid electrode configured to apply a voltage to the grid and located at an outer surface of the housing in the first direction; and a guide wall located between the cleaning electrode and the grid electrode in the first direction, the guide wall being inclined to be away from the roller portion in the first direction toward the grid electrode in the second direction, the image forming apparatus comprising:

a main housing;

a first electrical contact configured to contact the cleaning electrode when the drum cartridge is mounted on the main housing; and a second electrical contact configured to contact the grid electrode when the drum cartridge is mounted on the main housing, wherein when the drum cartridge is mounted onto the main housing, the guide surface is configured to guide the second electrical contact toward the guide wall in a case where the guide surface contacts the second electrical contact;

the guide wall is configured to guide the second electrical contact toward the grid electrode in a case where the guide wall contacts the second electrical contact; and the guide surface is configured to guide the first electrical contact toward the contact surface in a case where the guide surface contacts the first electrical contact; and when the second electrical contact contacts the grid electrode, the cleaning electrode contacts the first electrical contact.

* * * * *